US010624413B2

(12) United States Patent
Kirk et al.

(10) Patent No.: US 10,624,413 B2
(45) Date of Patent: Apr. 21, 2020

(54) SOLE FOR A SHOE

(71) Applicant: adidas AG, Herzogenaurach (DE)

(72) Inventors: Robert Frank Kirk, Nuremberg (DE); Constantin Zwick, Nuremberg (DE); Benjamin Turck, Nuremberg (DE); Zachary Clinton Coonrod, Nuremberg (DE)

(73) Assignee: adidas AG, Herzogenaurach (DE)

( * ) Notice: Subject to any disclaimer, the term of this patent is extended or adjusted under 35 U.S.C. 154(b) by 164 days.

(21) Appl. No.: 15/016,656

(22) Filed: Feb. 5, 2016

(65) Prior Publication Data

US 2016/0227873 A1 Aug. 11, 2016

(30) Foreign Application Priority Data

Feb. 6, 2015 (DE) ..... 10 2015 202 169

(51) Int. Cl.
*A43B 5/02* (2006.01)
*A43B 13/22* (2006.01)
*A43C 15/16* (2006.01)

(52) U.S. Cl.
CPC ..... *A43B 5/025* (2013.01); *A43B 13/223* (2013.01); *A43C 15/162* (2013.01)

(58) Field of Classification Search
CPC ..... A43B 5/02; A43B 5/025; A43B 13/223; A43C 15/16; A43C 15/162; A43C 15/167
USPC ..... 36/128, 133, 67 A, 59 C
See application file for complete search history.

(56) References Cited

U.S. PATENT DOCUMENTS 3,525,165 A * 8/1970 Randall, Jr. ..... A43B 5/02 36/128
4,454,662 A * 6/1984 Stubblefield ..... A43B 5/00 36/102
4,507,879 A * 4/1985 Dassler ..... A43B 5/02 36/102
5,437,112 A * 8/1995 Johnston ..... A43B 5/02 36/128
5,461,801 A * 10/1995 Anderton ..... A43B 3/0052 24/713.4
6,016,613 A * 1/2000 Campbell ..... A43B 5/001 36/127
6,523,282 B1 * 2/2003 Johnston ..... A43B 5/02 36/133
7,954,259 B2 * 6/2011 Antonelli ..... A43B 1/0009 36/25 R
8,291,617 B2 10/2012 Halberstadt et al.
8,631,590 B2 * 1/2014 Droege ..... A43B 5/02 36/102
8,789,298 B2 * 7/2014 Eder ..... A43B 5/02 36/133

(Continued)

FOREIGN PATENT DOCUMENTS

DE 3127793 C1 1/1983
EP 0340053 B1 11/1989

(Continued)

*Primary Examiner* — Sharon M Prange
(74) *Attorney, Agent, or Firm* — Sterne, Kessler, Goldstein & Fox P.L.L.C.

(57) ABSTRACT

A sole for a sports shoe comprises a plurality of profile elements and a friction element. The profile elements are distributed such that the friction element can contact a sports ball to increase the friction between a lower side of the sole and the sports ball.

21 Claims, 3 Drawing Sheets

(56) References Cited

U.S. PATENT DOCUMENTS

| | | | | |
|---|---|---|---|---|
| 8,844,171 | B2 * | 9/2014 | Eder | A43B 1/0009 36/132 |
| 2010/0107448 | A1 | 5/2010 | Fallow et al. | |
| 2011/0258883 | A1 | 10/2011 | Eder et al. | |
| 2013/0067774 | A1 * | 3/2013 | Auger | A43B 5/02 36/103 |
| 2013/0125417 | A1 | 5/2013 | Minami | |
| 2015/0128453 | A1 * | 5/2015 | Oroszi | A43B 5/025 36/134 |

FOREIGN PATENT DOCUMENTS

| | | | |
|---|---|---|---|
| EP | 1484991 | B1 | 12/2004 |
| GB | 2412287 | | 9/2005 |
| JP | S49-121731 | U | 10/1974 |
| WO | WO 20091149055 | | 12/2009 |
| WO | WO 2014/016629 | A1 | 1/2014 |

* cited by examiner

SOLE FOR A SHOE

BACKGROUND OF THE INVENTION

Field of the Invention

The present invention relates to soles for shoes, in particular soles for sports shoes, and to shoes having such soles.

Background Art

Shoes such as sports shoes generally comprise an upper and a sole.

Usual functions of a sole of a shoe may be to protect the foot from sharp objects which may be stepped on, to provide cushioning and to provide stability on the ground such that slipping may be prevented. Numerous designs of shoe soles are known which aim at fulfilling the above functions. For example, for providing a stable contact between the shoe and the ground, a sole may comprise profile elements, e.g., studs or naps, which may be adapted to penetrate the ground. Different designs for profile elements of soles are known from, e.g., EP 0 340 053 B1 or DE 31 27 793 C1.

A basic functionality of an upper of a shoe may in turn be to fix the foot within the shoe and on the sole. Various further functions may be provided by an upper depending on the specific application of the shoe. Uppers may, e.g., provide a good ventilation or heat insulation or they may prevent water from entering the shoe. In particular for soccer shoes, an upper may be optimized for controlling a soccer ball.

For example, EP 1 484 991 B1 discloses a cover for a lace-up footwear which comprises solely a continuous elastically expandable sleeve, wherein the exterior of the top of the sleeve includes a roughened zone to assist in control of a ball. Further, GB 2 412 287 discloses a band that wraps around the sweet spot of a soccer boot with a coating that increases the friction between the soccer ball and the soccer boot allowing the ball to be struck with greater accuracy. WO 2009/149055 A1 discloses an article of footwear for soccer with flexing portions in an arch portion of a sole system. The sole system includes trapping portions that enhance the ability of a wearer to stop and capture a ball.

However, in modern ball sports such as soccer, the speed and the requirements on the technical skills of the players are ever increasing. Therefore, there is a need to provide improved shoes which allow for higher speed and for better ball control.

BRIEF SUMMARY OF THE INVENTION

The above need is at least partly met by a sole for a sports shoe according to claim 1.

In an embodiment, a sole for a sports shoe, in particular a soccer shoe, comprises a plurality of profile elements and a friction element. The profile elements are distributed such that the friction element can contact a sports ball to increase the friction between a lower side of the sole and the sports ball.

Thus, a shoe may be provided which allows improved control of the ball not only on the upper but also when touching the ball with the lower side of the sole of the shoe. At the same time, by means of the profile elements a sufficient stability on the ground may be provided by the sole. The sole of the present invention may thus provide an improved ball control effectively allowing a player to control the ball with all sides of the shoe. Instead of separately optimizing the ball control by means of the upper and the stability on the ground by means of profile elements on the sole, both functionalities may be provided by the sole itself.

The above aspects may enable a wide range of new tricks, e.g., for soccer players and open up a new avenue for this sport. A seamless 360° ball control zone around the entire foot may be provided leading to new playing techniques that may bring the sport to a higher level. In particular, a sole which is suitable for the emerging sport of urban soccer may be provided. This type of soccer is played at high speed on a small pitch of artificial turf. The sole of the present invention is suitable to meet the high levels of ball control and of traction required for that matter.

The plurality of profile elements may be adapted to penetrate the ground. Hence, they may be particularly suited to prevent a sliding of the sole on the ground. For example, the profile elements may comprise studs and/or naps and/or ridges etc., or they may simply be implemented as studs.

The plurality of profile elements may be provided in the heel portion and/or in the forefoot portion of the sole. In these portions particularly great forces may arise when carrying out quick turns or movements. The presence of the profile elements in these portions may thus provide a particularly increased stability of the sole on the ground.

The profile elements may be arranged around the friction element. This may ensure that the profile elements do not interfere with the friction element, but at the same time, the sole still provides stability at a portion of the sole which comprises a friction element. For example, a friction element may be arranged in the forefoot portion and at least some of the plurality of profile elements may be arranged in the forefoot portion around the friction element. Thus, the sole may provide good traction on the ground and good ball control in the forefoot portion of the shoe in which good stability is particularly important and which is most often used for contacting the ball when playing soccer.

The friction element may be arranged in a forefoot portion and/or a medial side of a midfoot portion and/or in a heel portion of the sole. The friction element may be at least partly wrapped around the forefoot portion of the shoe.

The friction element may be permanently attached to the sole. A cumbersome attaching and detaching of a friction element by the user may thus be unnecessary. At the same time, a slipping or an accidental sliding off of the friction element, e.g., during running or kicking may be avoided. For example, the friction element may be permanently attached by means of gluing which may provide a durable connection even under rough outdoor conditions.

The friction element may comprise a material which provides a greater friction with a sports ball compared to a material of the profile elements, e.g., rubber. In other words, it may be the material of the friction element itself which provides the greater friction without necessarily requiring a specific surface structure of the friction element. The friction element may be designed without any geometric limitations. In particular, the friction element may be essentially flat on its outer side, which allows a simpler manufacturing and leads to less material being required.

The friction element may comprise an outer layer of rubber. The outer layer may be provided on a base layer, in particular a textile layer. Instead of rubber it is also possible to use, for example, TRU or silicone, which may be rolled, sprayed, injected or screen printed on the base layer. It is also possible that just a piece of rubber is used as the friction element without any base layer.

The textile layer comprising the rubber layer may, for example, be glued to the sole. The rubber layer may be applied to the textile layer before gluing to the sole. The textile layer may be optimized to provide a good permanent connection with the sole. The rubber layer may be essentially flat. Alternatively, the rubber layer may comprise a surface structure.

The friction element may extend from the lateral side of the forefoot portion to the medial side of the forefoot portion. Hence, across the entire sole an increased level of ball control may be provided when contacting a sports ball in the forefoot portion. Such a sole may be particularly suited for a soccer shoe in which the forefoot portion plays an important role for ball control.

The sole may comprise a recess for receiving the friction element. By means of the recess, for example, an essentially flush arrangement of the friction element and the lower side of the sole may be provided. This may further increase the ball control when contacting the ball at the edges of the friction element and allow for a more durable connection of the friction element on the sole.

The plurality of profile elements may comprise at least one first profile element and a plurality of elongate second profile elements. The elongate second profile elements may be distributed around the first profile element and extend radially from the first profile element. This arrangement may allow for a particularly improved stability of the sole on the ground despite the arrangement of the profile elements in such a manner that a sports ball may contact the friction element on the lower surface of the sole. By arranging the second profile elements around the first profile element, the stability provided by the first profile element may be increased. The first profile element(s) may thus be adapted to be shorter, such that the requirements to the distance between first profile elements in order to allow a sports ball to contact the friction element are less stringent.

The at least one first profile element may essentially be radially symmetric. This may allow for an easy rotation of the first profile elements on the ground when turning. At the same time, a similar degree of stability may thus be provided in all directions. This basic stability provided by the first profile elements may be refined, possibly asymmetrically, as needed by means of the second profile elements.

The at least one first profile element may be arranged in a forefoot portion or in a heel portion of the sole. In some embodiments, several first profile elements may be provided in the forefoot and/or in the heel portion of the sole. The first profile elements arranged in these portions may provide a shoe with particularly increased stability on the ground.

The elongate second profile elements may be smaller in height than the at least one first profile element. Hence, the first profile elements may provide a basic anchoring of the sole. The shorter second profile elements may be arranged to provide a more refined fine-tuning of the traction provided by the sole. The height of the second profile elements may be adapted to artificial turf.

The sole may comprise at least one first profile element and a plurality of second profile elements, wherein the plurality of second profile elements is arranged lattice-like, e.g., around the at least one first profile element. The second profile elements may be elongate. The second profile elements can also be arranged to comprise crossing points and/or connection points, where at least two second profile elements cross each other and/or connect to each other. For example, at one crossing point six second profile elements can run together.

The elongate second profile elements may have a longitudinal extension which is larger than a diameter of the at least one first profile element. The first profile elements may thus be arranged "locally" whereas the elongate second profile elements may extend over a larger portion of the sole. Since the second profile elements are elongate, a second profile element comprises a longitudinal extension which is larger than its width. A longitudinal extension of one or more or all of the elongate second profile elements may be at least twice as large as any diameter of the first profile element(s). At the same time, a width of one or more or all of the elongate second profile elements may be smaller than, or at least two times smaller than, a diameter of the first profile element(s). By means of the thusly elongated second profile elements particular stability with respect to torsion and sliding of the sole may be provided.

In another aspect of the present invention, a shoe, in particular a sports shoe, is provided which comprises a sole as described above.

In such a shoe, the friction element may extend at least partly across an upper of the shoe. Thus, seamless ball control in an area extending from the lower side of the sole to the upper of the shoe may be provided. Moreover, a friction element extending from the sole partly across the upper may help to provide a tight connection between sole and upper. The friction element may be designed to extend across various regions of the upper, e.g., an instep region in the forefoot portion of the upper. The friction element may comprise a material which provides greater friction with a sports ball compared to a material of the upper.

The friction element may at least partly encompass a forefoot portion of the upper and a forefoot portion of the sole. Such a friction element may provide a seamless 360° region around the forefoot portion of the shoe in which the ball control properties may be improved. The friction element may be glued to the sole and the upper to provide a durable connection. An inner surface of the friction element and an outer surface of the upper and the sole may be adapted to provide a stable connection when being glued.

It is also possible that the friction element is removably connected to the sole and/or the upper, for example, by a hook and loop fastener system, by a suitable glue, by screws or the like. Thus, it is possible to replace a used friction element by a new friction element, for example, when the friction element is worn-out or when a friction element with a different grade of friction is needed. It is also possible to use a removable friction element to tighten or untighten the shoe in a forefoot portion. Thereby the fit of the shoe can be improved. Friction elements may have different colors, so that a removably connected friction element can be replaced by another friction element in a different color. Further, it is possible that the removable friction elements have different materials or different designs. For example, a first friction element can be used for wet conditions and a second friction element can be used for dry conditions. For this reason the removable friction elements can comprise different materials, for example, rubber, silicone, TPU, textile materials or other materials which provide suitable friction with a ball or combinations thereof. For example, in case the friction element comprises a base layer on which a layer of rubber or the like is attached, the rubber material may be deposited on the base layer in different ways to create different shapes or patterns of the rubber material on the base layer. Different shapes or pattern may lead to different friction characteristics. Thus, it is possible to create friction elements with different coefficients of friction.

A business model of the removably connected friction elements could be that a shoe with a sole according to the invention and the friction elements are sold separately. The shoe with the sole could be sold without a friction element. It is also possible that the shoe is sold with one or two friction elements as basic equipment or with a set of friction elements. The shoe could be directly adjusted to athletes and sold to them. Further, friction elements or sets of friction elements can be sold separately. The friction elements can, for example, differ in size, material, color, design or the like as described above. Customers who have already acquired a shoe with the sole according to the invention can further acquire various friction elements according to their wishes. Further, customers may order their shoes with a certain friction element. In that case the placement of the friction element could happen at the factory, according to a modular conception.

The shoe may also comprise one or more further friction elements, which are arranged in various portions of the upper and/or the sole. For example, the one or more further friction elements may be arranged in a forefoot and/or a heel portion of the upper and/or the sole.

Another aspect of the present invention is a sole, e.g., an outsole, for a sports shoe, in particular a soccer shoe which comprises at least one first profile element and a plurality of elongate second profile elements. The elongate second profile elements are distributed around the at least one first profile element and extend radially from the at least one first profile element. Such a sole may be provided with or without a friction element described above. In particular, such a sole may include the various features described above and further below with respect to more detailed embodiments, in particular with respect to the first and second profile elements, independently of a possibly present friction element. A further aspect of the present invention is a shoe, in particular a sports shoe, with such a sole.

BRIEF DESCRIPTION OF THE FIGURES

Possible embodiments of the present invention will be described in more detail in the subsequent detailed description with reference to the following figures:

FIG. 4A, 4B shows a sole with a friction element and first and second profile elements according to some embodiments.

FIG. 5A, 5B shows cross sectional views of second profile elements according to some embodiments.

DETAILED DESCRIPTION OF THE INVENTION

Embodiments of the present invention will be described below mainly with reference to soccer shoes for simplicity. However, the concept of the present invention may similarly be applied to other types of sports shoes, e.g., rugby shoes, mountain bike shoes or snowboard shoes.

Moreover, for brevity only a few embodiments can be described in the following. The skilled person will recognize that the specific features described with reference to these embodiments may be modified and combined differently and that individual features may also be omitted if they are not essential. The general explanations in the sections above will also be valid for the following more detailed explanations.

Figure 1:
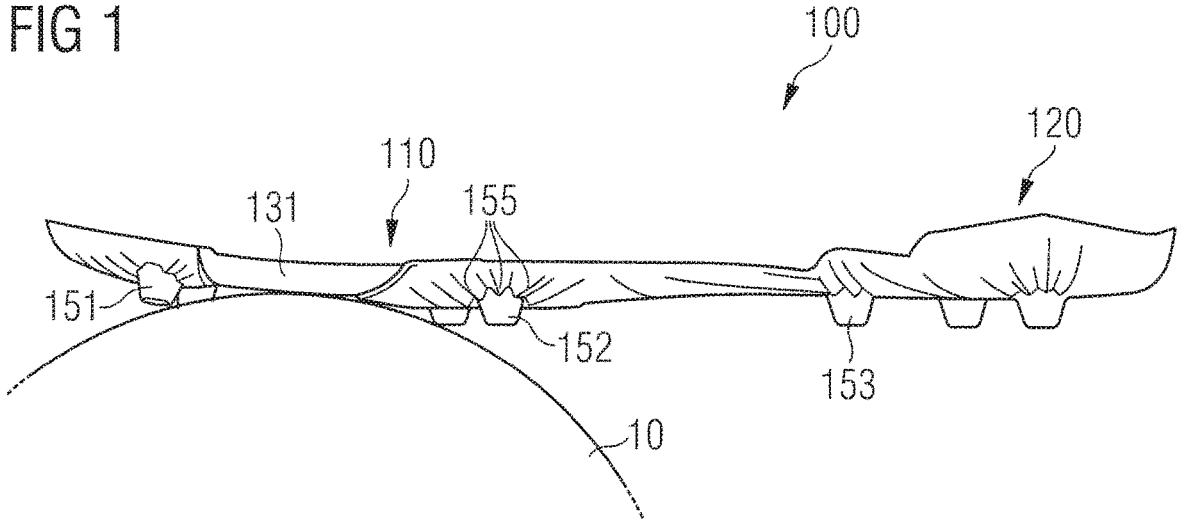
FIG. 1 shows a sole with profile elements and with a recess for a friction element according to some embodiments.

FIG. 1 shows an embodiment for a sole 100, e.g., an outsole, for a shoe, in particular for a soccer shoe or an urban soccer shoe. The sole 100 comprises a plurality of first profile elements 151-153 which are arranged in the forefoot portion 110 of the sole 100 and in the heel portion 120 of the sole 100. Moreover, the sole 100 comprises a plurality of second profile elements 155 which are arranged in the forefoot portion 110, the heel portion 120 and also in a midfoot portion. The first and second profile elements 151-153, 155 are adapted to provide the sole 100 with stability on the ground. In addition, the sole 100 comprises a recess 131 in the forefoot portion 110, which is adapted to receive a friction element for contacting a sports ball 10 to increase the friction between the lower side of the sole 110 and the sports ball 10. The first and second profile elements 151-153, 155 are distributed on the sole such that the friction element placed in the recess 131 may provide an area of contact between the lower side of the sole 100 and the ball 10. That is, the dimensions of the profile elements and the distances of the profile elements to each other are designed such that an area of contact between the sports ball 10, e.g., a soccer ball, and the friction element on the lower side of the sole is enabled. An area of contact may, e.g., be provided for a typical soccer ball (size 5) having a perimeter of 68-70 cm. However, also an area of contact adapted for smaller size sports halls may be provided. The sole 100 may be monolithic, i.e. the first and second profile elements may be fabricated together with the sole in a one-step procedure, e.g., via injection molding or other methods, e.g., 3D-printing. In other embodiments, the first and/or second profile elements may be fabricated separately. The materials of the first and second profile elements may be different. Optionally, the second profile elements and base portions of the first profile elements may be fabricated in a one-step procedure together with the sole, and an additional fabrication step may be used to provide top portions of the first profile elements. It is also possible first to provide top portions of the first profile element and afterwards in an additional fabrication step, the second profile elements and base portions of the first profile elements are provided.

The recess 131 extends from a lateral to a medial side of the forefoot portion 110. Moreover, the recess 131 comprises an average width of approximately 2-8 cm, or 3-7 cm, depending on the size of the shoe the sole 100 is intended for. The first profile elements 151 and 152 are arranged at a distance to each other that is slightly larger than the width of the recess 131, e.g., 5-10 cm, depending on their height. Depending on the thickness of the friction element that is to be inserted into the recess 131, the depth of the recess may vary in the range of, e.g., 0.25-5 mm, 0.5-4 mm or 1-3 mm. In some embodiments, the recess 131 is designed such that the friction element is flush with the lower side of the sole 100. The above dimensions indicated with respect to the recess 131 thus may also apply to the friction element to be inserted into the recess 131. Providing a recess 131 for the friction element may improve the durability of the connection between the friction element and the sole 100. However, a recess 131 is not required to provide a durable connection and may thus in other embodiments also be omitted. The first profile elements 151, 152 are arranged around the recess 131 which is provided for the friction element.

The first profile elements 151-153 have a general cylindrical shape which may be tapered towards the ground. The diameter of the first profile elements 151-153 at their top may be in the range of 4-15 mm, or in the range of 6-12 mm. The bottom diameter of the first profile elements 151-153 may be in the range of 50-80% of the top diameter, or in the range of 60%-70% of the top diameter. The first profile elements 151-152 in the forefoot portion 110 may have a smaller diameter than the first profile elements 153 in the heel portion 120. Their diameter may be reduced by 0-40% or by 10-30%. The height of the first profile elements 151-153 may be in the range of 3-15 mm, or in the range of 4-10 mm. The height of first profile elements 151-152 in the forefoot portion 110 may be smaller than that of first profile elements 153 in the heel portion 120. For example, first profile elements 151-152 in the forefoot portion 110 may comprise a height of 6-8 mm, whereas first profile elements 153 in the heel portion 120 may comprise a height of 9-12 mm. Also, within the forefoot and/or heel portion 110, 120, respectively, the dimensions of the first profile elements 151-153 may vary. For example, one or more first profile elements in a front portion of the forefoot portion 110, e.g., a toe portion, may comprise a height of approximately 5 mm, whereas one or more first profile elements in a rear portion of the forefoot portion 110 may comprise a height of approximately 6 mm. As a further example, one or more first profile elements in a front portion of the heel portion 120, i.e. a portion closer to the forefoot portion 110, may comprise a height of approximately 9 mm, whereas one or more first profile elements in a rear portion of the heel portion 120 may comprise a height of approximately 10 mm. In other embodiments, a first profile element with non-radially-symmetric shapes may be provided, e.g., rectangular, quadratic, triangular etc. The heights and diameters indicated above for cylindrically shaped first profile elements may also be used for these non-radially-symmetric shapes.

In embodiments of sole 100, the second profile elements 155 have a lower height than the first profile elements 151-153. A second profile element 155 may have an average height in the range of 0.5-10 mm, 1-8 mm, or 2-6 mm. The second profile elements 155 are elongate and distributed around the first profile element 152, wherein they extend radially therefrom. In embodiments of sole 100, the elongate second profile elements 155 each has a longitudinal extension which is larger than a diameter of the first profile element 152. Second profile elements 155 may extend from a first profile element in the forefoot portion 110 to a first profile element in the heel portion 120.

Figure 2:
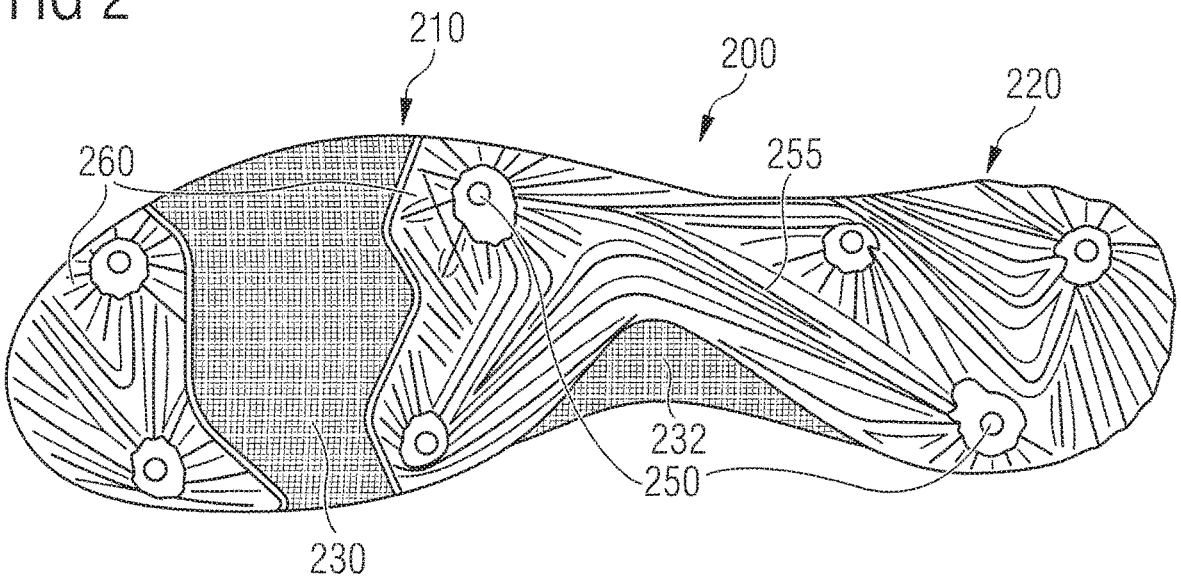
FIG. 2 shows a sole with a friction element and first and second profile elements according to some embodiments.

FIG. 2 shows an embodiment for a sole 200. The sole 200 comprises a plurality of first profile elements 250 arranged in a forefoot portion 210 and a heel portion 220 of the sole. Moreover, the sole 200 comprises a plurality of second profile elements 255. The first and second profile elements 250, 255 are arranged in regions 260. The regions 260 are provided in a front portion (e.g., toe portion) and a rear portion of the forefoot portion 210, in the heel portion 120 and a lateral side of a midfoot portion of the sole 200. The sole 200 moreover comprises a friction element 230 which is arranged in the forefoot portion 210. The friction element 230 extends from a medial side to a lateral side of the forefoot portion 210, wherein its width on average decreases from the lateral to the medial side of the sole 200. It is also possible that the width of the friction element 230 decreases from the medial to the lateral side of the sole 200. Further it is possible that the width of the friction element 230 keeps constant from the medial to the lateral side of the sole 200 or varies like an S-curve. It may, for example, have a width of more than 2 cm or more than 4 cm. In other embodiments, the friction element 230 may not extend from the lateral to the medial side. Instead it may be arranged on a lateral side, a medial side or in a region, e.g., in the center of the forefoot portion 210. Such a friction element may have a lateral extension of 2-10 mm, 3-8 mm or 3-6 mm. It may comprise a lateral extension covering more than ¼, ⅓, ½ or ⅔ of the lateral extension of the forefoot portion 210 of the sole 200. The friction element 230 may be arranged in a recess of the sole 200. It is also possible that the friction element 230 extends from the lateral side in direction to the medial side, however not totally up to the medial side. This enables that the medial side is free of any friction element. The medial side is often used for kicking a ball. So if there is no friction element on the medial side, the wear out of the friction element can be reduced.

The friction element 230 may comprise a base layer on which a layer of rubber may be rolled, sprayed, injected, screen printed etc. For example, a rubber material may be deposited on the base layer to achieve a desired shape or pattern of the rubber material on the base layer. In an embodiment, a rubber material may be applied in liquid or otherwise pliable form and subsequently a surface structure may be created within the rubber layer by means of a stamp etc. or an essentially flat rubber layer may be created. The rubber material may then be dried, e.g., with heat. In some embodiments a contiguous layer of rubber is applied on the base layer and/or a regular surface structure pattern is created thereon to provide a homogeneous degree of friction on the outer surface of the friction element 230. In other embodiments, specific areas of the friction element 230 may be provided with different properties. This may be particularly the case if the friction element 230 extends over a large area, possibly including a portion on an upper of a shoe, as will be explained with respect to FIG. 3. A base layer may, for example, comprise a textile layer, e.g., knitted, non-woven or woven material. A friction element comprising, e.g., rubber may, however, also be applied on the sole without a base layer. Instead of rubber it is also possible to use, for example, TPU or silicone, Which may be rolled, sprayed, injected or screen printed on the base layer.

In embodiments of sole 200, an additional friction element 232 is attached to the sole 200 at a medial side of the midfoot portion such that improved control of a ball may be achieved there also. In other embodiments different and/or further friction elements may be added, e. g. in the heel portion.

The profile elements 250 and 255 of the sole 200 may be designed as explained with reference to FIG. 1. Four first profile elements 250 may be provided in the forefoot portion 210, wherein each of the front portion, and rear portion of the forefoot portion 210 comprises a pair of first profile elements 250. One first profile element 250 of each pair is arranged at a lateral side and the other one is arranged at a medial side of the sole 200. The two first profile elements 250 at the lateral side of the sole 200 may be spaced farther apart from each other than those two at the medial side. In addition, three first profile elements 250 may be provided in the heel portion 220 of the sole 200. Two of them may be arranged at the lateral side of the sole 200 and the third one may be arranged at the medial side of the sole 200, approximately equally spaced in between the two on the lateral side. A second profile element 255 may extend across the entire midfoot portion and/or connect first profile elements 250 in the forefoot portion 210 and the heel portion 220 of the sole 200. A second profile element 255 may extend from a first profile element 250 on the lateral side of the forefoot portion 210 to a first profile element 250 on the medial side of the heel portion 220. This may strengthen the sole in the midfoot portion. The second profile elements 255 which extend across the entire midfoot portion are designed to support sideward movements. One or more of the second profile elements 255 may have a longitudinal extension of more than 3 cm, more than 6 cm, or more than 9 cm. Adjacent second profile elements 255 may be approximately spaced by 1-15 mm, 3-12 mm, or 4-10 mm. Around a first profile element 250 second profile elements 255 may be approximately equally spaced. In one quadrant around a first profile element 250, e.g., 2-12, 3-9 or 4-5 second profile elements 255 may be arranged.

Further second profile elements 255 may extend in the forefoot portion or a front portion thereof (e.g., toe portion). The second profile elements 255 in the front portion are designed to support fast sprinting movements.

Further second profile elements 255 may extend in a rear portion of the sole (e. g. heel portion). The second profile elements 255 in the heel portion are designed to support a grip on the ground.

Figure 3:
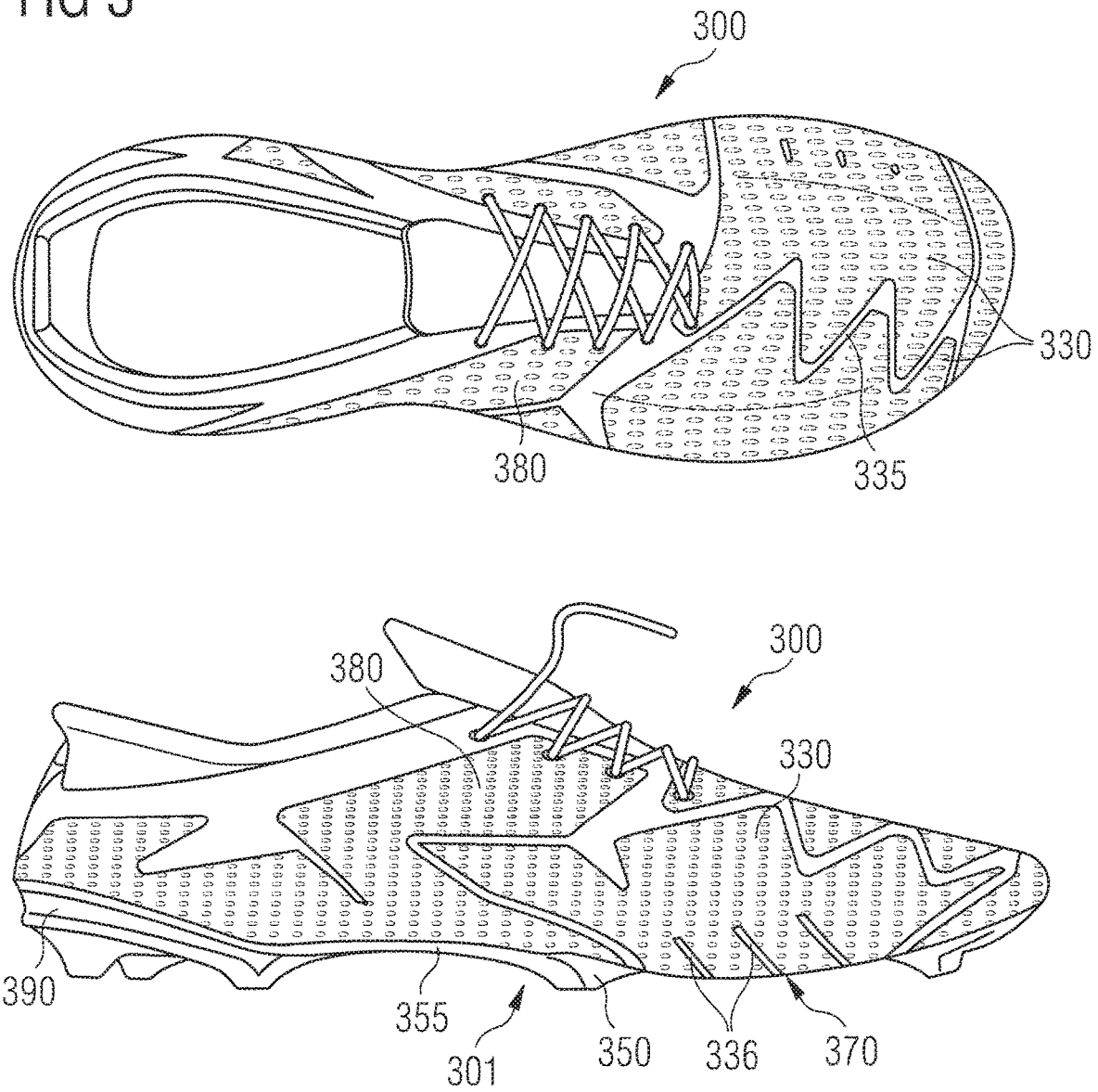
FIG. 3 shows a shoe with a sole and with friction elements according to some embodiments.

FIG. 3 shows a top and a side view of an embodiment of a shoe 300, in particular a soccer shoe or an urban soccer shoe. The shoe 300 comprises a sole 301 with a plurality of first profile elements 350 and second profile elements 355 which may be designed as explained with respect to FIGS. 1 and/or 2. In embodiments of sole 301, the transition between the first profile elements 355 and the lower surface of the sole 301 may be designed to be smoother than in the soles 100 and 200 of FIGS. 1 and 2, respectively. The first profile elements 350 are also tapered and, on their narrower end, they may comprise a diameter of 4-12 mm, or 6.10 mm. The second profile elements 355 of the sole 301 may be substantially similar to those as explained with reference to FIGS. 1 and 2. The sole 301 also comprises an optional heel reinforcement portion 390.

As can be seen from FIG. 3, the profile elements 350, 355 of the sole are arranged such that an area of contact 370 may be provided between the lower surface of the sole 301 and a sports ball, e.g., a soccer ball. A friction element 330 is arranged on the sole 301 such that a ball may contact the friction element 330 on the lower side of the sole 301 to provide increased friction between the lower side of the sole 301 and the sports ball. The friction element 330 also extends partly across the upper of the shoe 300. In particular, the friction element 330 extends from a medial side of a forefoot portion of the upper around the area 370 of the sole 301 to a lateral side of the forefoot portion of the upper. The friction element 330 may be partly wrapped around the forefoot portion of the shoe 300. Both ends of the friction element 330 are adapted to each other such that these are arranged adjacent to each other with a small gap 355 on the upper of the shoe 300.

As a result, an almost 360° area of contact with increased ball control is provided in the forefoot portion of the shoe 300 by friction element 330. In other embodiments, the gap 335 may be shaped differently or no such gap may be provided. If no gap or at least no continuous gap is provided, the friction element 330 encompasses the forefoot portion. In some embodiments, the friction element 330 may fully encompass the forefoot and/or other portions of the shoe 300. Alternatively, the friction element 330 may partly encompass the forefoot portion of the shoe, e.g., leaving open a toe portion of the shoe 300. Optionally, the friction element 330 may comprise one or more slots 336.

The friction element 330 may be glued to the surface of the upper and the sole 301, respectively, wherein the lower side of the friction element may be adapted to durably connect with the upper and the sole 301, respectively. The friction element 330 may also be used to tighten the shoe 300. For example, the friction element may be applied, e.g., wrapped, around the forefoot portion under tension, such that the forefoot portion is tensioned. As an option, the friction element 330 may not be glued to the upper and/or the sole 301. The friction element 330 may be provided removably connected to the sole and/or the upper, for example, by a hook and loop fastener on the upper and/or the sole side of the friction element 330 to tighten the friction element 330 such that it may be used to tighten the forefoot portion of the shoe 300. Instead of a hook and loop fastener suitable glues, screws or the like could be used. Thus, it would be possible to replace a used friction element 330 by a new friction element 330, for example, when the friction element 330 is worn-out or when a friction element 330 with a different grade of friction is needed. It is also possible that removable friction elements 330 have different colors, so that a removably connected friction element 330 can be replaced by another friction element 330 in a different color. Further it is possible that the removable friction elements 330 have different materials or different designs. For example, a first friction element 330 can be used for wet conditions and a second friction element 330 can be used for dry conditions. For this reason the removable friction elements 330 can comprise different materials, for example, rubber, silicone, TPU, textile materials or other materials which provide suitable friction with a ball or combinations thereof. For example, in the case that the friction element 330 comprises a base layer on which a layer of rubber or the like is attached, the rubber material may be deposited on the base layer in different ways to create different shapes or patterns of the rubber material on the base layer. Different shapes or pattern may lead to different friction characteristics, Thus, it is possible to create friction elements 330 with different coefficients of friction.

It is also possible that the friction element 330 is wrapped around the forefoot portion of the shoe 300 in a way that distal ends of the friction element 330 are overlapping each other, e.g. in a middle region of the forefoot portion of the upper and/or the sole 301. In this case a first distal end is attached to a second distal end, whereby the second distal end is attached to the upper and/or sole 301.

In addition to the friction element 330 one or more further friction elements 380 may be provided on the shoe 300. These may be arranged in various portions of the upper and/or the sole 301 in which increased friction is desirable. Friction, elements 380 may be attached to the upper in the same manner as described with respect to friction element 330. Additionally or alternatively one or more friction elements 380 may not cover a portion of the sole 301 and/or may be attached to the upper around the lower side of the upper before attaching the sole 301 to the upper of the shoe 300. The one or more further friction elements 380 may be arranged essentially flush with the friction element 330 on the upper and/or the sole 301. The one or more further friction elements 380 and the friction element 330 may not overlap, and gaps may be provided between the friction elements. It is also possible that the friction elements 330, 380 are at least partly overlapping each other, whereby the friction elements 330, 380 are also attached to each other. Further it is possible that the wrapped around friction element 330 is attached to one of the further friction elements 380 and not to the upper.

Figure 4A:
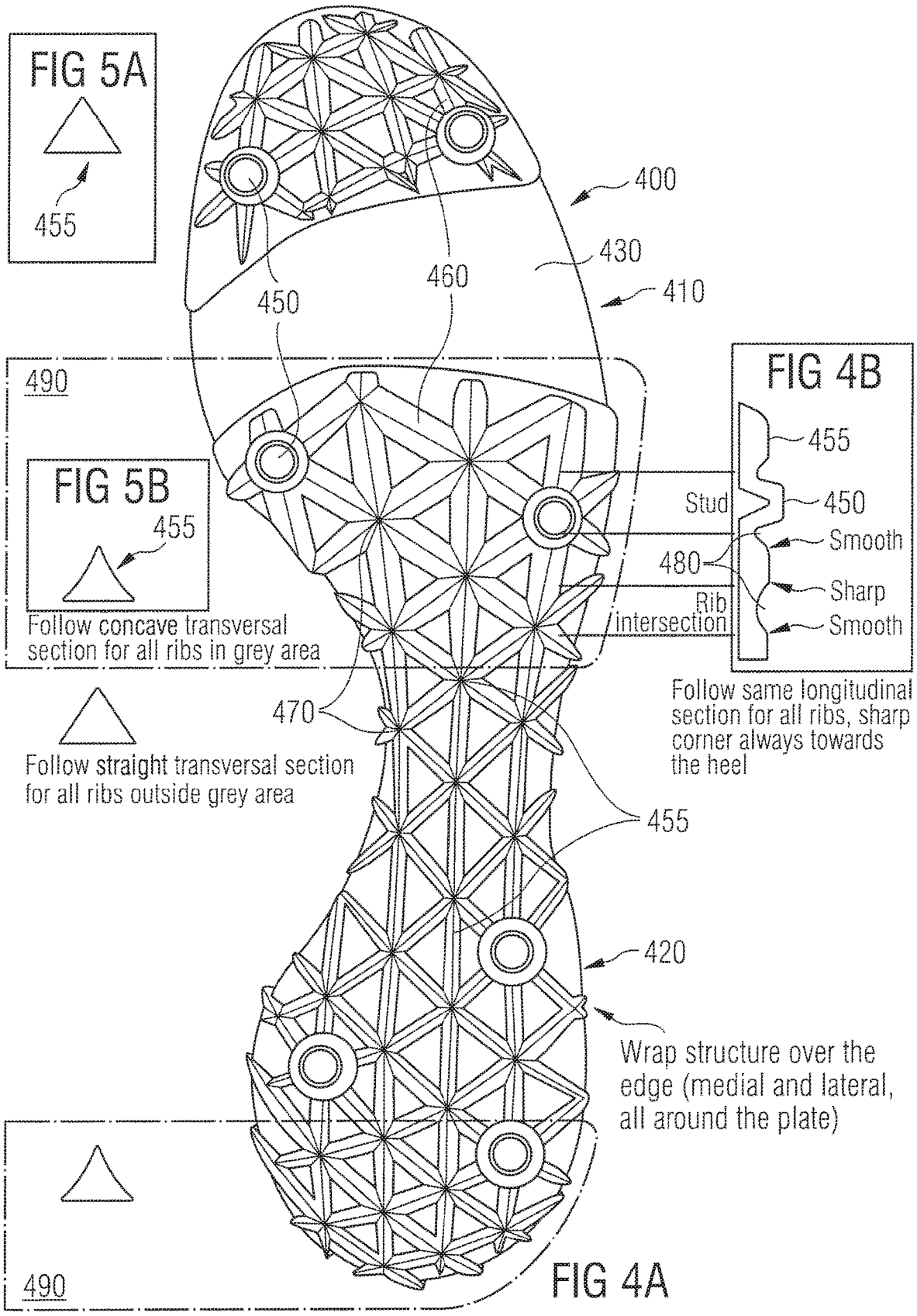

FIG. 4A and FIG. 4B show an embodiment for a sole 400. The sole 400 comprises a plurality of first profile elements 450 arranged in a forefoot portion 410 and a heel portion 420 of the sole. Moreover, the sole comprises a plurality of second profile elements 455. The first and second profile elements 450, 455 are arranged in regions 460. The regions 460 are provided in a front portion (e.g., toe portion) and a rear portion of the forefoot portion 410, in a midfoot portion, and in the heel portion 420. The sole 400 moreover comprises a friction element 430 which is arranged in the forefoot portion 410. The friction element 430 may be arranged between the front portion and the rear portion of the forefoot portion 410. The friction element 430 extends from a medial side to a lateral side of the forefoot portion 410, wherein its width on average decreases from the lateral to the medial side of the sole 400. The friction element 430 can be designed and/or arranged as described in connection with FIGS. 1-3.

The first profile elements 450 of the sole 400 may be designed as explained with reference to FIGS. 1-3. For example, four first profile elements 450 may be provided in the forefoot portion 410, wherein each of the front portion and rear portion of the forefoot portion 410 comprises a pair of first profile elements 450. One first profile element 450 of each pair is arranged at a lateral side and the other one is arranged at a medial side of the sole 400. The two first profile elements 450 at the lateral side of the sole 400 may be spaced farther apart from each other than those two at the medial side. In addition, three first profile elements 450 may be provided in the heel portion 420 of the sole 400. Two of them may be arranged at the lateral side of the sole 400 and the third one may be arranged at the medial side of the sole 400, approximately equally spaced in between the two on the lateral side.

In embodiments of sole 400, the second profile elements 455 have a lower height than the first profile elements 450. In embodiments of sole 400 the second profile elements 455 are arranged lattice-like. Second profile elements 455 may extend from a first profile element 450 in the forefoot portion 410 to a first profile element 450 in the heel portion 420.

The second profile elements 455 are elongate and distributed around the first profile elements 450. Some of the second profile elements 455 cross each other. As shown in FIG. 4A, there are crossing points and/or connection points 470 of the second profile elements 455. At the crossing points and/or connection points 470 there can be cavities 480 as shown in FIG. 4B. There also can be cavities 480 between the first profile elements 450 and the second profile elements 455 as shown also in FIG. 4B. The cavities 480 may comprise sharp corners pointing towards the heel portion 420, and/or smooth corners pointing towards the toe portion of the sole 400, as exemplarily shown in FIG. 4B. It is also possible that there are no such cavities 480 at all.

The second profile element 455 may extend across the entire midfoot portion, the entire heel portion 420 and/or the entire forefoot portion 410 of the sole 400. The second profile elements 455 connect first profile elements 450 in the forefoot portion 410, e.g., those in the rear portion of the forefoot portion 410, and the heel portion 420 of the sole 400. The second profile elements 455 which extend from the first profile elements 450 of the forefoot portion 410 to the first profile elements 450 of the heel portion 420 also strengthen the sole 400 in the midfoot portion.

As can be seen in FIG. 4A, the second profile elements 455 can comprise a wrap structure over the edges of the sole 400, especially in the midfoot portion, the rear portion of the forefoot portion 410 and/or in the heel portion 420, e.g., they may at least partly extend over the edges of the sole 400. The wrap structure may not be present in the front portion of the forefoot portion 410.

As can be seen in FIGS. 5A and 5B, the second profile elements 455 can be designed in different cross sections, for example, having a triangular cross section and/or a concave triangular cross section. In embodiments of sole 400 the second profile elements 455 in the toe portion of the forefoot portion 410 are designed with a triangular cross section as shown in FIG. 5A. Further, the second profile elements 455 in a portion between the friction element 433 and a midfoot portion, e.g., a rear portion of the forefoot portion 410, are designed with a concave triangular cross section as shown in FIG. 5B. Further, the second profile elements 455 in the midfoot portion and/or a front portion of the heel portion 420 are designed in triangular cross section as shown in FIG. 5A, whereby the second profile elements 455 in the region of the heel counter, e.g., a rear portion of the heel portion 420, can be designed with a concave triangular cross section as shown in FIG. 5B. Exemplary regions with a concave triangular cross section (as shown in FIG. 5B) of the second profile elements 455 are indicated by reference sign 490 in FIG. 4A. Second profile elements 455 may have a triangular cross section (as shown in FIG. 5A) in regions outside the regions 490.

A method for manufacturing a shoe may comprise the following steps: A sole with a plurality of profile elements is provided. An upper is provided. A friction element is attached at least partly around the sole and the upper such that the friction element can contact a sports ball to increase the friction between a lower side of the sole and the sports ball. The method may be adapted to provide shoes and shoes with soles as explained with reference to FIGS. 1-4.

What is claimed is:

1. A sole for a sports shoe comprising:

a plurality of first profile elements comprising four studs disposed in a forefoot portion of the sole, the four studs arranged in a forward pair and a rearward pair;

a friction element extending between the forward pair and the rearward pair from a lateral edge of the sole to a medial side of the sole, wherein the friction element comprises a material which provides a greater friction with a sports ball compared to a material of the plurality of first profile elements; and a plurality of second profile elements on the sole, wherein the plurality of second profile elements are elongated and extend from the lateral edge to the medial side of the sole in the forefoot portion forward of the friction element and in a heel portion rearward of the friction element, and wherein the four studs are distributed such that the friction element can contact a sports ball to increase the friction between a lower side of the sole and the sports ball.

2. The sole of claim 1, wherein the plurality of profile elements are adapted to penetrate the ground.

3. The sole of claim 1, wherein the friction element is permanently attached to the sole.

4. The sole of claim 1, wherein the friction element comprises an outer layer of rubber that is provided on a textile layer.

5. The sole of claim 1, further comprising a recess for receiving the friction element.

6. The sole of claim 1, wherein the plurality of second profile elements are distributed around and extend radially from each of the four studs.

7. The sole of claim 6, wherein the four studs are essentially radially symmetric.

8. The sole of claim 6, wherein the plurality of first profile elements further comprises studs arranged in a heel portion of the sole.

9. The sole of claim 6, wherein the plurality of second profile elements are smaller in height than the four studs.

10. The sole of claim 6, wherein the plurality of second profile elements have a longitudinal extension which is larger than a diameter of the four studs.

11. The sole of claim 1, wherein the plurality of second profile elements are arranged lattice-like.

12. A sports shoe comprising a sole according to claim 1.

13. The shoe of claim 12, wherein the friction element extends at least partly across an upper of the shoe.

14. The shoe of claim 13, wherein the friction element at least partly encompasses a forefoot portion of the upper and the forefoot portion of the sole.

15. The shoe of claim 13, wherein the shoe comprises one or more further friction elements, which are arranged in a heel portion of the upper.

16. The shoe of claim 12, wherein the shoe comprises one or more further friction elements, which are arranged in a heel portion of the sole.

17. The sole of claim 1, wherein each of the forward pair and the rearward pair comprises a medial stud and a lateral stud, and wherein the lateral studs are spaced farther apart from each other than the medial studs.

18. The sole of claim 1, wherein a width of the friction element decreases from a lateral side of the sole to the medial side of the sole.

19. The sole of claim 1, wherein the friction element extends to a medial edge of the sole.

20. A sole for a sports shoe comprising:

a plurality of first profile elements comprising studs disposed in a forefoot portion of the sole;

a friction element that extends from a lateral edge of the sole to a medial side of the sole in the forefoot portion of the sole, wherein the friction element provides a greater friction with a sports ball compared to a material of the plurality of first profile elements; and a plurality of second profile elements arranged in a lattice-pattern in the forefoot portion of the sole forward of the friction element and in the heel portion of the sole rearward of the friction element.

21. The sole of claim 20, wherein each of the plurality of second profile elements comprises a triangular cross sectional area.

* * * * *